US011170742B2

(12) United States Patent
Murakami et al.

(10) Patent No.: US 11,170,742 B2
(45) Date of Patent: Nov. 9, 2021

(54) SOSTENUTO MECHANISM FOR KEYBOARD INSTRUMENT AND KEYBOARD INSTRUMENT

(71) Applicant: YAMAHA CORPORATION, Hamamatsu (JP)

(72) Inventors: Hiroyuki Murakami, Kakegawa (JP); Yusuke Takashima, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/163,729

(22) Filed: Feb. 1, 2021

(65) Prior Publication Data

US 2021/0264883 A1 Aug. 26, 2021

(30) Foreign Application Priority Data

Feb. 21, 2020 (JP) ..... JP2020-027999

(51) Int. Cl.
*G10D 3/12* (2020.01)
*G10C 3/26* (2019.01)
*G10C 3/12* (2006.01)

(52) U.S. Cl.
CPC ..... *G10C 3/26* (2013.01); *G10C 3/12* (2013.01)

(58) Field of Classification Search
CPC ..... G10C 3/26; G10C 3/12; G10D 3/00
See application file for complete search history.

(56) References Cited

U.S. PATENT DOCUMENTS 5,892,165 A * 4/1999 Oba ..... G10F 1/02 75/246

FOREIGN PATENT DOCUMENTS

JP H0317355 Y 4/1991

* cited by examiner

*Primary Examiner* — Kimberly R Lockett
(74) *Attorney, Agent, or Firm* — Rossi, Kimms & McDowell LLP

(57) ABSTRACT

A sostenuto mechanism linked to a sostenuto pedal and a sostenuto rod of a keyboard instrument, and the keyboard instrument are provided. The sostenuto mechanism includes a fixed member configured to be fixed to at least one of a middle beam or a key bed of the keyboard instrument, a movable member movably supported by the fixed member, and a movement transmission. The movement transmission is configured to be interposed between the sostenuto pedal and the movable member to transmit movement of the sostenuto pedal to the movable member. The moveable member is movable relative to the fixed member to turn the sostenuto rod in response to depression of the sostenuto pedal.

10 Claims, 5 Drawing Sheets

SOSTENUTO MECHANISM FOR KEYBOARD INSTRUMENT AND KEYBOARD INSTRUMENT

BACKGROUND

Technical Field

The present disclosure relates to a sostenuto mechanism for a keyboard instrument and a keyboard instrument including the same.

A technology disclosed in Japanese Unexamined Utility Model Application Publication (JP-Y) No. H03-17355 is known as a sostenuto mechanism for a keyboard instrument. In the disclosed sostenuto mechanism, when a sostenuto pedal is depressed, a lift rod moves an operation rod up and down via a pivoted lever, and the operation rod turns a sostenuto rod.

To install the sostenuto mechanism in a keyboard instrument in the technique disclosed in JP-Y No. H03-17355, it was necessary to adjust, for each keyboard instrument, the position of a hole, through which the sostenuto rod is inserted, in a key bed in a front-back direction, and the positions of various components of the sostenuto mechanism, in consideration of differences in lengths in a depth direction of the keyboard of every instrument and/or other differences. Therefore, the sostenuto mechanism needed to be designed for each keyboard instrument model.

SUMMARY

In view of the foregoing, one or more aspects of the disclosure are directed to a sostenuto mechanism for a keyboard instrument that allows sharing parts of the sostenuto mechanism among a plurality of models, and a keyboard instrument including the sostenuto mechanism.

In one aspect of the disclosure, there is provided a sostenuto mechanism for a keyboard instrument including a sostenuto pedal, a sostenuto rod, a key bed, and a middle beam (which is also referred to as a middle rail) located above a rear part of the key bed. The sostenuto mechanism is linked to the sostenuto pedal and the sostenuto rod. The sostenuto mechanism includes a fixed member configured to be fixed to at least one of the middle beam or the key bed. The sostenuto mechanism further includes a movable member movably supported by the fixed member, where the movable member is movable relative to the fixed member to turn the sostenuto rod in response to depression of the sostenuto pedal. The sostenuto mechanism further includes a movement transmission configured to be interposed between the sostenuto pedal and the movable member to transmit movement of the sostenuto pedal to the movable member.

In another aspect of the disclosure, a keyboard instrument includes a key bed; a middle beam (or a middle rail) located above a rear part of the key bed; a damper pedal; strings; dampers that touch the respective strings from above; and damper mechanisms. The damper mechanisms support the respective dampers to be freely movable in an up-down direction of the keyboard instrument, and move the respective dampers away from the respective strings in response to depression of the damper pedal. The keyboard instrument further includes protrusions that are arranged in the respective damper mechanisms and protrude in a direction substantially orthogonal to a moving direction of the dampers; a sostenuto pedal; a sostenuto rod including a turnable ledge; and the above-described sostenuto mechanisms linked to the sostenuto pedal and the sostenuto rod.

Further features of the disclosure will become apparent from the following description of exemplary embodiments with reference to the attached drawings.

DETAILED DESCRIPTION

Hereinafter, some embodiments will be described with reference to the drawings.

First Embodiment

Figure 1:
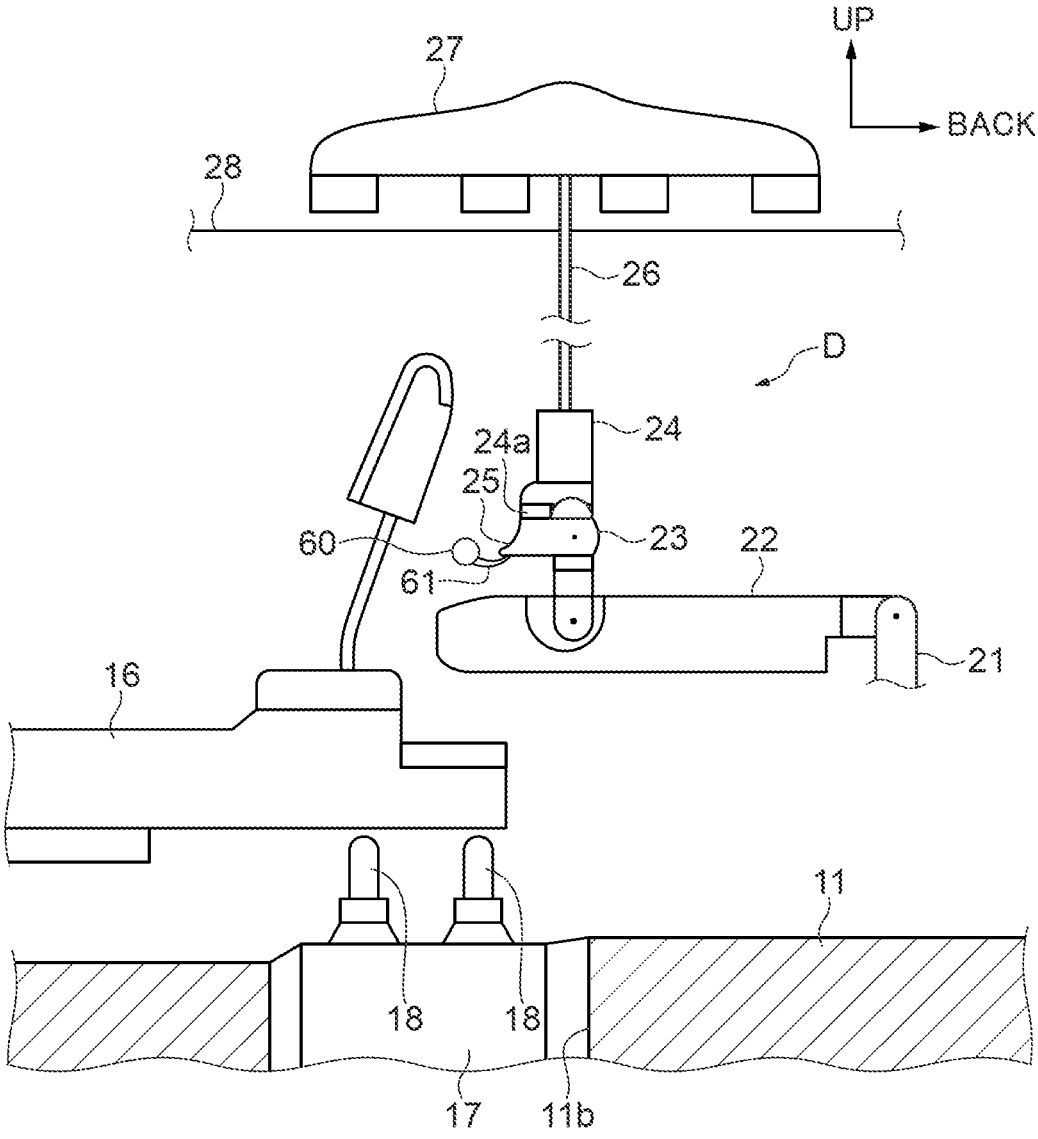
FIG. 1 is a partial cross-sectional view of a keyboard instrument equipped with a sostenuto mechanism according to a first embodiment.

FIG. 1 is a partial cross-sectional view of a keyboard instrument including a sostenuto mechanism according to a first embodiment. In particular, FIG. 1 illustrates a rear part of one key 16 and a damper mechanism D. Hereinafter, the side of a player playing the keyboard instrument will be referred to as a front side (left side in FIG. 1), and a front-back (front-rear) direction, an up-down (vertical) direction and a left-right direction will be referred to in directions viewed from the player.

This keyboard instrument includes a key bed 11. Above the key bed 11, a plurality of keys 16 is arranged side by side in the left-right direction. Each key 16 is supported via a balance pin (not illustrated) to be freely pivotable. When the front end of a key 16 is pressed down, the rear end of the key 16 rises. A storing slot 11*b* is formed in the key bed 11. The storing slot 11*b* is formed long in the left-right direction of the key bed 11. A key actuation system 17 (see also FIG. 4) is stored inside the storing slot 11*b*. The key actuation system 17 is provided with the same number of solenoid units 18 as the keys 16, so as to automatically actuate the keys 16. When the keyboard instrument is automatically played with the key actuation system 17, the solenoid unit 18 raises the rear end of the corresponding key 16 to pivot the key 16.

A hammer action mechanism (not illustrated) is provided for each key 16. When a key 16 is pivoted by a player or the corresponding solenoid unit 18, it activates the corresponding hammer action mechanism and a hammer of the hammer action mechanism strikes a corresponding string 28 to produce a sound. A damper mechanism D for silencing the string 28 is provided on a rear side of the hammer action mechanism.

Damper lever flanges 21 are mounted on a damper rail provided across a key area of the keyboard (for example, from the first key to the 69th key among 88 keys) for which dampers are provided. Each damper lever flange 21 supports one end of a damper lever 22, which extends in the front-back direction, to be freely pivotable. The damper lever 22 is provided corresponding to each key 16. A damper block 24 is attached to the front end, which is a free end, of the damper lever 22 to be freely pivotable. A tab lip 23 is attached to the damper block 24 to be freely pivotable. The tab lip 23 is energized by a spring that is not illustrated so as to turn clockwise in FIG. 1. Therefore, except when the sostenuto pedal 14 (FIG. 4) is depressed, the tab lip 23 is in contact with a felt 24*a* provided under the damper block 24. From the tab lip 23, a protrusion 25, which is a tip of the tab lip 23, protrudes in a direction substantially orthogonal to the moving direction of the dampers 27. Further, a damper wire 26 extending upward is attached to the damper block 24.

A damper 27 for touching the string 28 from above is attached to an upper end of the damper wire 26. The damper mechanism D supports the damper 27 to be freely movable in the up-down direction. Each damper mechanism D releases the damper 27 from the corresponding string 28 in response to depression of a damper pedal (not illustrated). When a key 16 is pressed, the rear end of the key 16 raises the damper lever 22, and the damper 27 moves away upward from the corresponding string 28 immediately before the hammer hits the string 28. Vibrations of the string 28 from which the damper 27 is apart are not suppressed by the damper 27.

A cylindrical sostenuto rod 60 is provided as a member that the sostenuto mechanism links to. The sostenuto rod 60 is supported to be freely turnable on an axis of the sostenuto rod 60 by a bearing (not illustrated) fixed to an upper part of the keyboard instrument. On an outer surface of the sostenuto rod 60, a hard turnable ledge (shelf-shaped projection) 61 is provided. The turnable ledge 61 is formed along the axial direction of the sostenuto rod 60.

Figure 2:
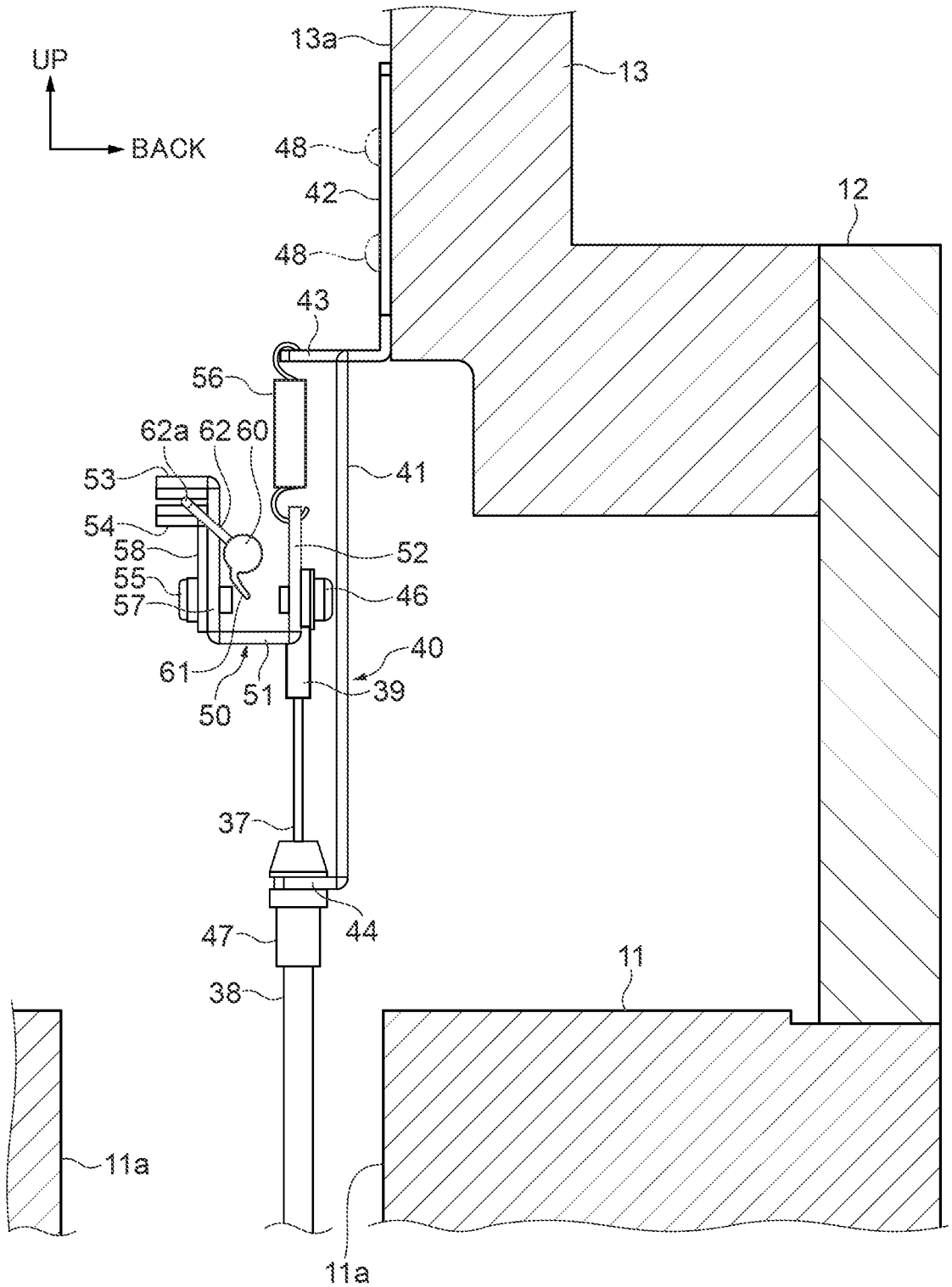
FIG. 2 is a cross-sectional view illustrating a main part of the sostenuto mechanism.
Figure 3:
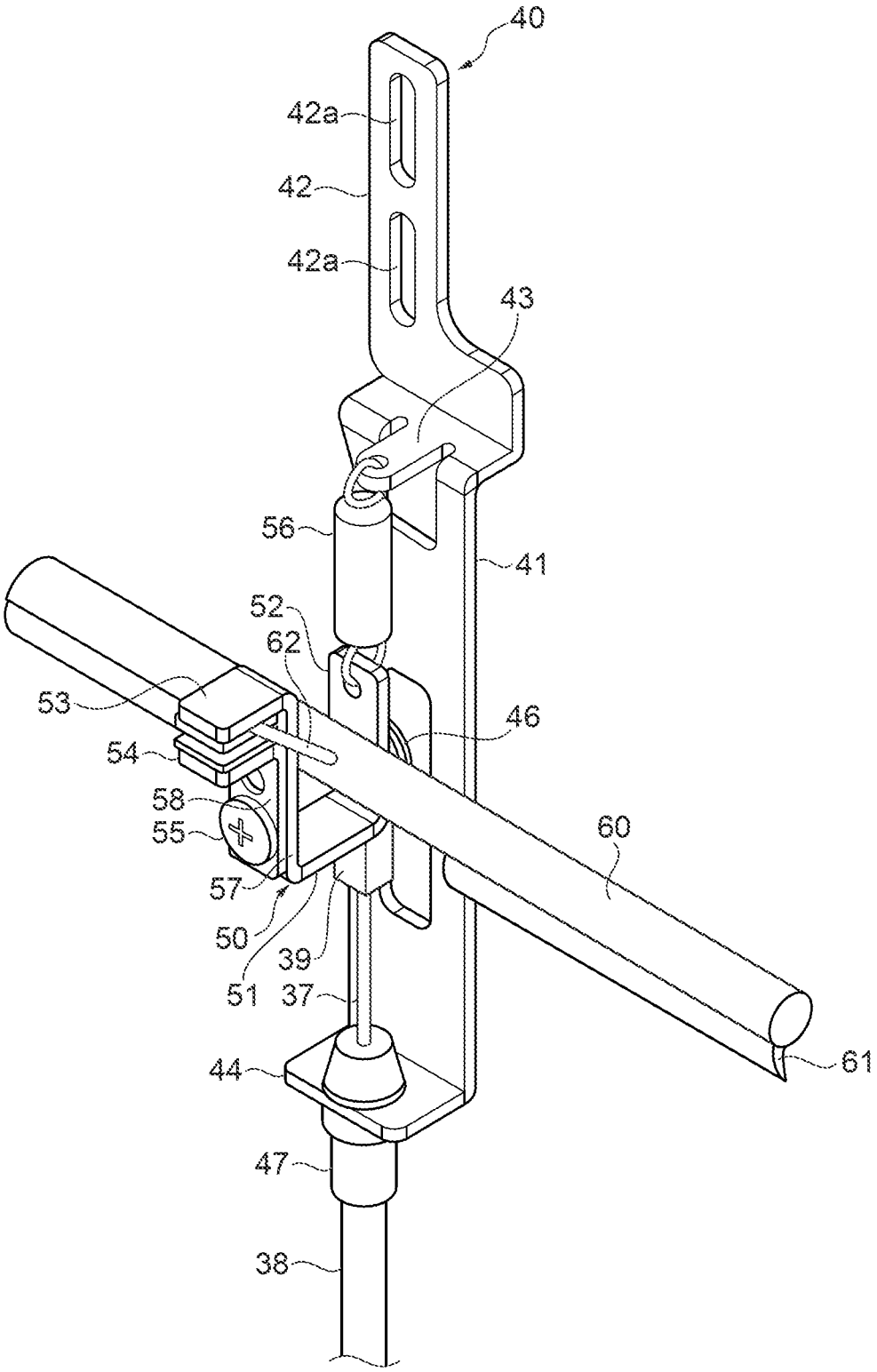
FIG. 3 is a perspective view illustrating the main part of the sostenuto mechanism.

FIGS. 2 and 3 are a cross-sectional view and a perspective view, respectively, illustrating a main part of the sostenuto mechanism.

In the sostenuto mechanism, a detailed configuration of which will be described later, when the sostenuto pedal 14 (FIG. 4) is depressed, it turns the sostenuto rod 60 counterclockwise in FIG. 1 and the turnable ledge 61 becomes substantially horizontal. In FIG. 1, a state where the sostenuto pedal 14 is depressed and the sostenuto function is working is illustrated. FIGS. 2 and 3 illustrate a state where the sostenuto pedal 14 is not depressed (initial position).

When a key 16 is turned by a key pressing action, the rear end of the key 16 lifts up the damper lever 22, and the damper wire 26 moves upward. When the damper wire 26 is raised, it releases the damper 27 from its contact with the string 28. When the turnable ledge 61 is brought into a horizontal state as illustrated in FIG. 1 with the key 16 being pressed, the protrusion 25 of the tab lip 23 corresponding to the key 16 being pressed is caught on the turnable ledge 61. Thus, the damper 27 is held away from the string 28. Therefore, even if the key 16 is released and returns to the initial position, a sound produced by striking the corresponding string 28 continues. That is, the sostenuto function works.

On the other hand, it is assumed that a key 16 that has not been pressed is pressed after the turnable ledge 61 has become horizontal. In this case, even if the key 16 turns and the damper lever 22 is lifted up, the tab lip 23 does not go above the turnable ledge 61. The reason for this is as follows. First, the protrusion 25 of the tab lip 23 comes in contact with a lower surface of the turnable ledge 61 in the course of upward movement of the damper block 24 and the tab lip 23 in response to a key pressing action. At that time, the tab lip 23 turns counterclockwise in FIG. 1, which prevents the protrusion 25 of the tab lip 23 from going above the turnable ledge 61. Therefore, when the key 16 returns to the initial position, the damper 27 immediately descends and comes in contact with the string 28, suppressing the string sound of the string 28.

A description is given of the configuration of the sostenuto mechanism with reference to FIGS. 2 and 3. This sostenuto mechanism is a mechanism linked to the sostenuto pedal 14 and the sostenuto rod 60, and mainly includes a fixed member 40, a movable member 50, and a wire 37 which works as a movement transmission. A single rod-shaped handle 62 extends from the sostenuto rod 60 in a direction orthogonal to the axial direction of the sostenuto rod 60 to form a shape of an L. The handle 62 includes, on the distal side, a driven part 62*a* that is a round bar part elongated in the left-right direction. In the keyboard instrument, a rear beam (which is also referred to as a rear rail) 12 is fixed to the rear part of a key bed 11. A middle beam (or a middle rail) 13 is fixed to the upper end part of the front face of the rear beam 12. That is, the middle beam 13 is located above the rear part of the key bed 11 to support a part of a sound board of the keyboard instrument.

The fixed member 40 includes a main part 41, a mounting piece 42, an upper horizontal part 43, and a lower horizontal part 44, and is made of metal or the like. A long hole 42*a* that is long in the up-down direction is formed in the mounting piece 42 (FIG. 3). The fixed member 40 is configured to be fixed to the middle beam 13 by being fastened to a front face 13*a* of the middle beam 13 with screws 48 through the long hole 42*a*. In a case where the fixed member 40 is fixed to the middle beam 13, the position of the fixed member 40 with respect to the front face 13*a* in the up-down direction is adjustable within a range in which the long hole 42*a* is formed. In this respect, the long hole 42*a* serves the function of a position adjuster.

The movable member 50 is supported by the fixed member 40 so as to be movable in the up-down direction relative to the fixed member 40. The movable member 50 mainly includes a U-shaped portion and an L-shaped portion. The U-shaped portion includes a first vertical part 52, a bottom part 51, a second vertical part 57, and an upper holding part 53. The L-shaped portion includes a facing part 58 facing the second vertical part 57 and a lower holding part 54.

A case fixing part 47 fixed to a wire case 38 is fixed to the lower horizontal part 44 of the fixed member 40. The wire case 38 extends into a hole 11*a* formed in the key bed 11. A wire 37, which is a flexible member, passes through inside the wire case 38 and the case fixing part 47. A connecting part 39 is fixed to an upper end of the wire 37. The movable member 50 and the connecting part 39 are fixed by fastening the first vertical part 52 of the movable member 50 and the connecting part 39 with a screw 46. It should be noted that a hole of the first vertical part 52 through which the screw 46 passes may be a long hole that is long in the up-down direction. Thus, the relative positions of the movable member 50 and the connecting part 39 in the up-down direction is adjustable according to the model of the keyboard instrument.

The upper horizontal part 43 of the fixed member 40 and an upper end of the first vertical part 52 of the movable member 50 are connected by a spring 56. The spring 56 is installed in a state of constantly receiving a pulling force. By appropriately selecting tension and a length of the spring 56 according to the model of the keyboard instrument, the initial position of the movable member 50 with respect to the fixed member 40 in the up-down direction can be set as desired.

In the movable member 50, the second vertical part 57 and the facing part 58 are fastened with a screw 55. The hole through which the screw 55 passes is a long hole that is long in the up-down direction. Therefore, when fastening the second vertical part 57 and the facing part 58, the position of the facing part 58 with respect to the second vertical part 57 in the up-down direction is adjustable. Appropriate adjustment of the position of the facing part 58 allows the driven part 62*a* of the handle 62 to be held with being pinched between the upper holding part 53 and the lower holding part 54. Therefore, the driven part 62*a* of the handle 62 is turnably held between the upper holding part 53 and the lower holding part 54.

As will be described later, when the sostenuto pedal 14 (see FIG. 4) is depressed, the wire 37 is pulled downward. When the wire 37 is pulled downward against the pulling force of the spring 56, the movable member 50 moves downward in parallel together with the connecting part 39. With the movement of the movable member 50, the driven part 62*a* of the handle 62, which is held between the upper holding part 53 and the lower holding part 54, moves downward while turning, and thus the sostenuto rod 60 turns counterclockwise in FIG. 2. That is, moving in response to depression of the sostenuto pedal 14, the movable member 50 turns the sostenuto rod 60. When the sostenuto pedal 14 is in a depressed state, the turnable ledge 61 becomes substantially horizontal (see FIG. 1).

Figure 4:
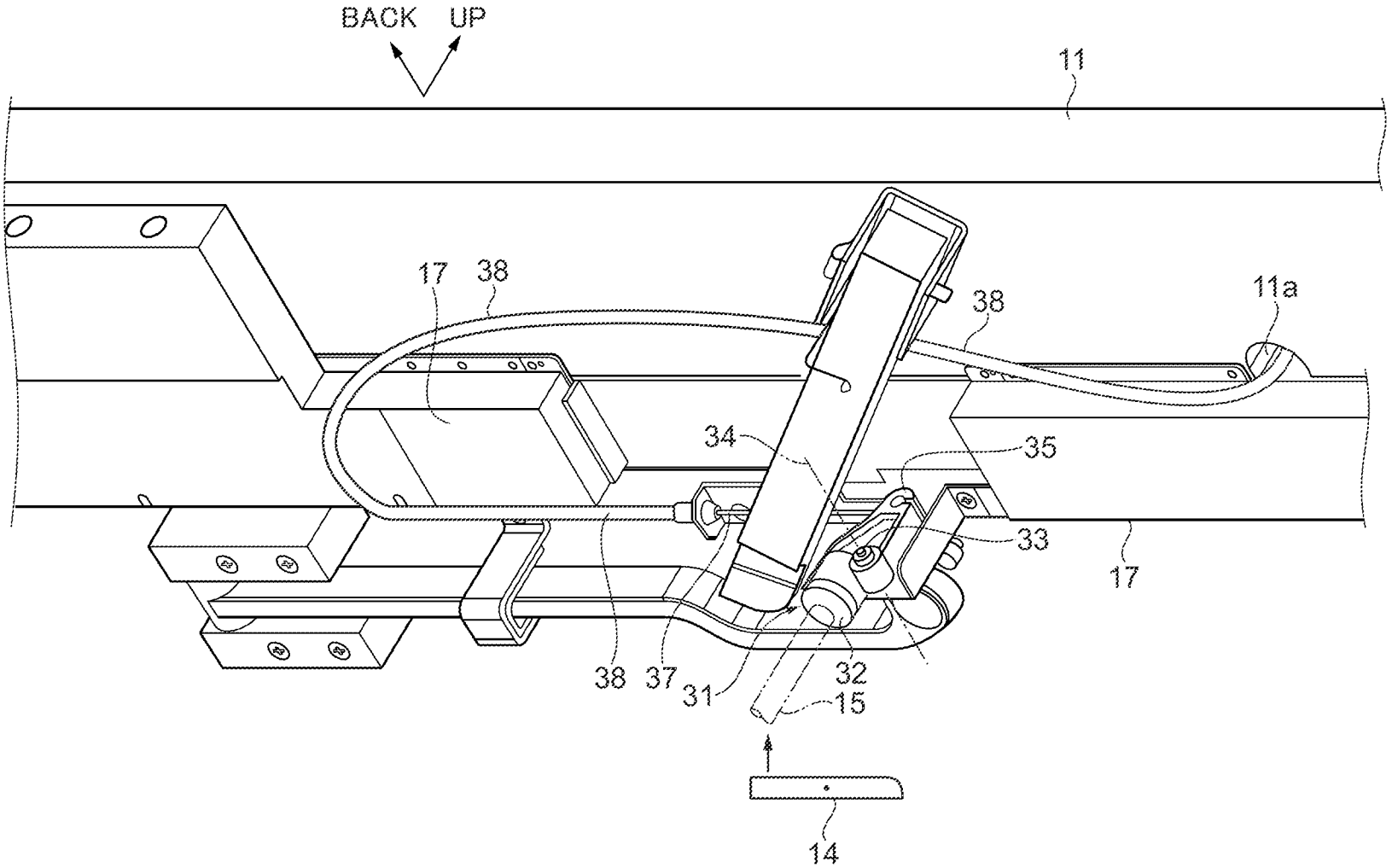
FIG. 4 is a perspective view of lower components of a key bed as seen obliquely from below.

FIG. 4 is a perspective view of lower components of the key bed 11 as seen obliquely from below. Running through the hole 11*a* (see also FIG. 2) of the key bed 11, the wire case 38 through which the wire 37 passes extends downward. The wire case 38 and a turnable member 31 are arranged below the key bed 11. The wire case 38 is fixed to the key bed 11 via a stay. The turnable member 31 is supported by a turn shaft 33 fixed to the key bed 11 via a stay. The turnable member 31 is freely turnable about a turn center 34 of the turn shaft 33. The turn center 34 is substantially parallel to the front-back direction. The turnable member 31 has a first end 32 and a second end 35. The wire 37 extending from the wire case 38 is connected to the second end 35 of the turnable member 31. The turnable member 31 is a driven member driven by a lift rod 15. The first end 32 of the turnable member 31 is driven by the upper end of the lift rod 15.

In the front-back direction, the turnable member 31 is arranged in front of the key actuation system 17, and the movable member 50 is arranged behind the key actuation system 17. Therefore, when viewed from the vertical direction, the turnable member 31 and the movable member 50 are arranged so as to sandwich the key actuation system 17 in the front-back direction. The wire case 38 is arranged to pass below the key actuation system 17. The wire 37 runs from the turnable member 31 into the hole 11*a* through the wire case 38, and is connected to the movable member 50. That is, the wire 37 is interposed between the sostenuto pedal 14 and the movable member 50, and serves as a movement transmission that transmits movement of the sostenuto pedal 14 to the movable member 50.

When the sostenuto pedal 14 is depressed, the lift rod 15 rises. When the lift rod 15 rises and the upper end of the lift rod 15 lifts up the first end 32 of the turnable member 31, the turnable member 31 turns about the turn center 34. Then, the second end 35 of the turnable member 31 pulls the wire 37 to the right in FIG. 4. When the wire 37 is pulled by the turnable member 31, a part of the wire 37 at the side of the movable member 50, which is illustrated in FIG. 2, is pulled downward. With the movement of the wire 37, the movable member 50 moves downward, and the sostenuto rod 60 turns counterclockwise in FIG. 2, as described above. As also described above, while the sostenuto pedal 14 is depressed with a key 16 being pressed and the turnable ledge becomes horizontal, the tunable ledge 61 supports the protrusion 25 of the tab lip 23 corresponding to the key 16 being pressed, at a position that causes the damper 27 to be apart from the string 28.

The lift rod 15 constantly receives a downward force by the spring 56 via the turnable member 31. When the depression of the sostenuto pedal 14 is released, the lift rod 15 moves downward by the pulling force of the spring 56 and returns to the initial position. In this process, a pulling force of the wire 37 becomes small, and thus the sostenuto rod 60 turns clockwise in FIG. 2 and returns to the initial position.

According to the present embodiment, the fixed member 40 is fixed to the middle beam 13, which makes the position of the fixed member 40 relative to the keyboard instrument (particularly the middle beam 13) in the front-back direction substantially uniform in various models of key keyboard instrument. That is, positioning of the fixed member 40 with respect to the middle beam 13 in the front-back direction is easy or unnecessary. This is because, in most cases, there is almost no difference between the relative positions of the middle beam and the sostenuto rod in the front-back direction depending on the model. Thus, upon installing a sostenuto mechanism in a keyboard instrument, it is easy to share the same parts among multiple models. Therefore, it enables parts of the sostenuto mechanism to be shared among a plurality of models.

It should be noted that if it is attempted to fix the fixed member 40 to the rear beam 12, it is difficult to attach the fixed member 40 to the rear beam 12 because there are other parts such as a lifting rail and a damper rail in front of the rear beam 12. By fixing the fixed member 40 to the middle beam 13, the sostenuto mechanism is installed in the keyboard instrument while easily avoiding interference with other parts.

Further, the turnable member 31 and the movable member 50 are arranged so as to sandwich the key actuation system 17 in the front-back direction when the keyboard instrument is viewed from the vertical direction, and the wire 37 is arranged to pass below the key actuation system 17. With such a configuration, since a member like a see-saw type lever is unnecessary, it becomes easy for the keyboard instrument to include both the key actuation function and the sostenuto function at the same time. In particular, when the conventional sostenuto mechanism is applied to a model having the key actuation system, it is difficult to arrange the see-saw type lever while avoiding interference with the key actuation system. However, in the present embodiment, since the see-saw type lever is unnecessary, it is easy to install the sostenuto mechanism even in the model having the key actuation system.

Further, with respect to the up-down direction, the position of the fixed member 40 with respect to the middle beam 13 is adjustable when they are fastened with screws 48 through the long hole 42*a*. Moreover, when the movable member 50 and the connecting part 39 are fastened with the screw 46, the position in the up-down direction of the movable member 50 with respect to the case fixing part 47 is adjustable. Therefore, these fastening positions substantially form a position adjuster capable of adjusting the position of the movable member 50 in the up-down direction with respect to the middle beam 13. Such position adjusters increase models of keyboard instrument that support the sostenuto mechanism and thus increase versatility of the sostenuto mechanism.

It should be noted that the movement transmission that transmits the movement of the sostenuto pedal 14 to the movable member 50 is not limited to the wire 37. For example, a member that transmits a pulling force caused by depression of the sostenuto pedal 14 to the movable member 50 will suffice as the movement transmission, and the movement transmission may include a flexible member other than wire in part.

It should be noted that the configuration for lifting up the lift rod 15 by depression of the sostenuto pedal 14 is not limited to the exemplified configuration.

Second Embodiment

Figure 5:
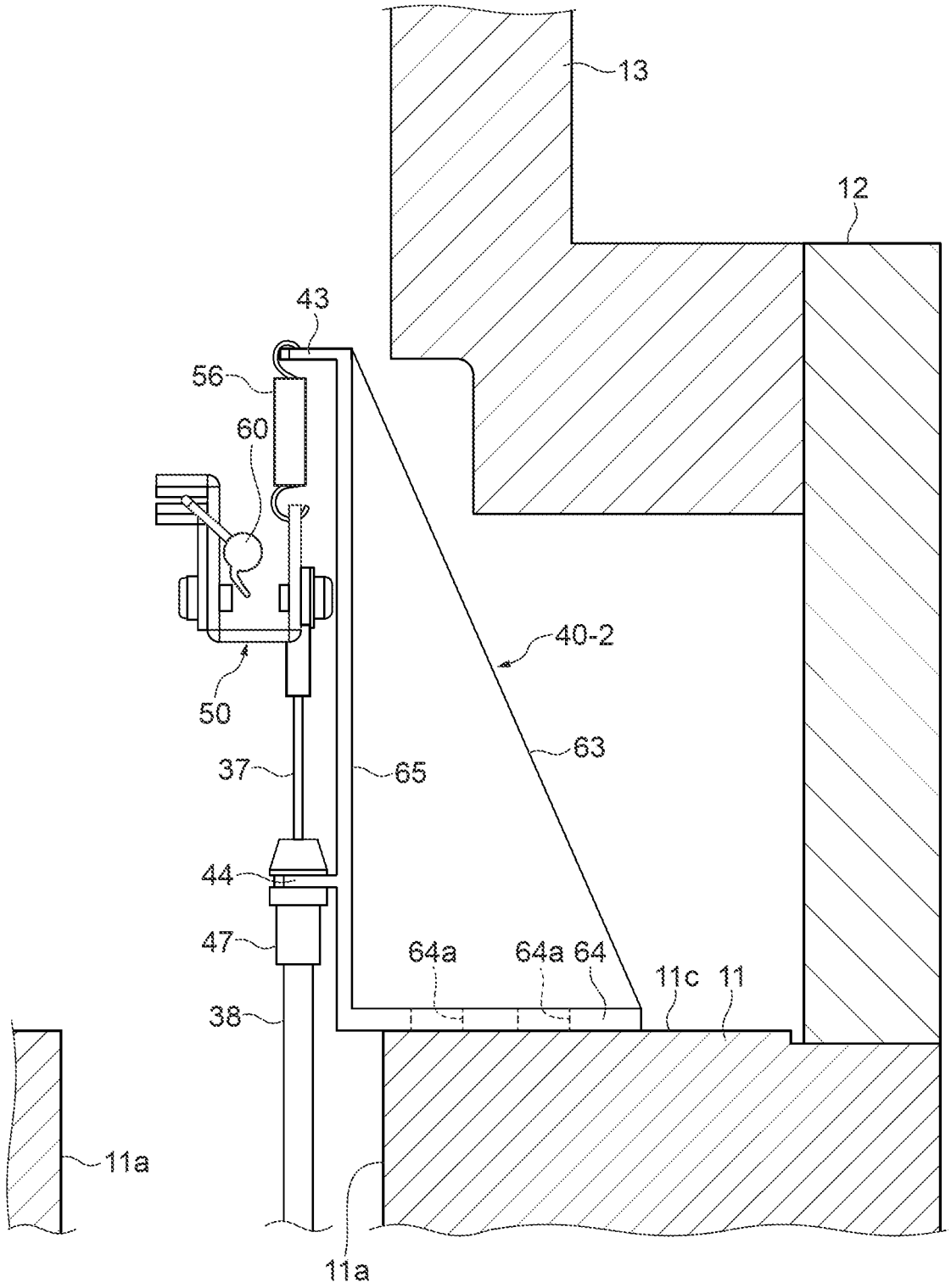
FIG. 5 is a cross-sectional view illustrating a main part of a sostenuto mechanism according to a second embodiment.

FIG. 5 is a cross-sectional view illustrating a main part of a sostenuto mechanism according to a second embodiment. In the present embodiment, the configuration of the fixed member is different from that of the first embodiment, and the other configurations are similar to those of the first embodiment.

As illustrated in FIG. 5, a fixed member 40-2 is configured to be fixed to the key bed 11 instead of the middle beam 13. In the example of FIG. 5, the fixed member 40-2 is fixed to an upper surface 11*c* of the key bed 11. A long hole 64*a* that is long in the front-back direction is formed in a mounting piece 64 that corresponds to the mounting piece 42. The mounting piece 64 is fastened to the upper surface 11*c* of the key bed 11 with a screw that is not illustrated through the long hole 64*a*. With the long holes 64*a*, the position of the fixed member 40-2 is adjustable with respect to the key bed 11 in the front-back direction. The function of a main part 65 is similar to that of the main part 41 (FIG. 2). A rib 63 connects the main part 65 and the mounting piece 64 for reinforcement, but is not essential.

In most cases, there is almost no difference in the relative position between the key bed and the sostenuto rod in the up-down direction depending on the model. Thus, when the fixed member 40-2 is fixed to the key bed 11, it makes the position of the fixed member 40-2 with respect to the keyboard instrument (particularly the key bed 11) in the up-down direction substantially uniform in various models of key keyboard instrument. That is, the positioning of the fixed member 40-2 with respect to the key bed 11 in the up-down direction is easy or unnecessary. Thus, upon installing the sostenuto mechanism in a keyboard instrument, it is easy to share the same parts among multiple models. Therefore, the present embodiment enables the parts of the sostenuto mechanism to be shared among a plurality of models.

It should be noted that the fixed member may be fixed to both the middle beam 13 and the key bed 11 according to both the first and second embodiments. If the sostenuto mechanism having such construction includes a position adjuster that works in the up-down direction or the front-back direction, it enables the sostenuto mechanism to be used for a more number of models.

While the disclosure has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-027999 filed on Feb. 21, 2020 which is hereby incorporated by reference herein in their entireties.

What is claimed is:

1. A sostenuto mechanism for a keyboard instrument including a sostenuto pedal, a sostenuto rod, a key bed, and a middle beam located above a rear part of the key bed, the sostenuto mechanism being linked to the sostenuto pedal and the sostenuto rod, and comprising:

a fixed member configured to be fixed to at least one of the middle beam or the key bed;

a movable member movably supported by the fixed member, the movable member being movable relative to the fixed member to turn the sostenuto rod in response to depression of the sostenuto pedal; and a movement transmission configured to be interposed between the sostenuto pedal and the movable member to transmit movement of the sostenuto pedal to the movable member.

2. The sostenuto mechanism according to claim 1, wherein:

the fixed member is fixed to the middle beam, and the sostenuto mechanism further comprises a position adjuster that adjusts a position of the movable member in an up-down direction of the keyboard instrument with respect to the middle beam.

3. The sostenuto mechanism according to claim 1, wherein the movement transmission transmits a pulling force to the movable member in response to depression of the sostenuto pedal.

4. The sostenuto mechanism according to claim 3, wherein the movement transmission comprises a flexible member.

5. The sostenuto mechanism according to claim 1, wherein:

the keyboard instrument includes:

a key actuation system that automatically plays the keyboard instrument;

a lift rod lifted up by depression of the sostenuto pedal; and a driven member driven by the lift rod, and in a state where the fixed member is fixed to the at least one of the middle beam or the key bed, the driven member and the movable member are arranged to sandwich the key actuation system in a front-back direction of the keyboard instrument when the keyboard instrument is viewed from a vertical direction, and the movement transmission comprises a flexible member that connects the driven member and the movable member.

6. A keyboard instrument comprising:

a key bed;

a middle beam located above a rear part of the key bed;

a damper pedal;

strings;

dampers that touch the respective strings from above;

damper mechanisms that support the respective dampers to be freely movable in an up-down direction of the keyboard instrument, and that move the respective dampers away from the respective strings in response to depression of the damper pedal;

protrusions that are arranged in the respective damper mechanisms and protrude in a direction substantially orthogonal to a moving direction of the dampers;

a sostenuto pedal;

a sostenuto rod including a turnable ledge; and sostenuto mechanisms linked to the sostenuto pedal and the sostenuto rod, each of the sostenuto mechanisms including:

a fixed member fixed to at least one of the middle beam or the key bed;

a movable member movably supported by the fixed member, the movable member being movable relative to the fixed member to turn the sostenuto rod in response to depression of the sostenuto pedal; and a movement transmission interposed between the sostenuto pedal and the movable member to transmit movement of the sostenuto pedal to the movable member, wherein the sostenuto rod is turned by movement of the movable member in response to depression of the sostenuto pedal to support, with the turnable ledge, at least one of the protrusions at a position that causes a corresponding one of the dampers to be apart from a corresponding one of the strings.

7. The keyboard instrument according to claim 6, wherein the fixed member is fixed to the middle beam, and the sostenuto mechanism further includes a position adjuster that adjusts a position of the movable member in the up-down direction with respect to the middle beam.

8. The keyboard instrument according to claim 6, wherein the movement transmission transmits a pulling force to the movable member in response to depression of the sostenuto pedal.

9. The keyboard instrument according to claim 8, wherein the movement transmission comprises a flexible member.

10. The keyboard instrument according to claim 6, further comprising:

a key actuation system that automatically plays the keyboard instrument;

a lift rod lifted up by depression of the sostenuto pedal; and a driven member driven by the lift rod, wherein the driven member and the movement member are arranged to sandwich the key actuation system in a front-back direction of the keyboard instrument when the keyboard instrument is viewed from a vertical direction, and wherein the movement transmission comprises a flexible member that connects the driven member and the movable member.

* * * * *